US007416014B2

(12) United States Patent
Coenraets

(10) Patent No.: US 7,416,014 B2
(45) Date of Patent: Aug. 26, 2008

(54) SHUTTER DEVICE WITH FLEXIBLE LATERAL EDGES

(75) Inventor: Benoit Coenraets, Brussels (BE)

(73) Assignee: Dynaco International, S.A., Brussels (BE)

( * ) Notice: Subject to any disclaimer, the term of this patent is extended or adjusted under 35 U.S.C. 154(b) by 0 days.

(21) Appl. No.: 10/508,217

(22) PCT Filed: Mar. 17, 2003

(86) PCT No.: PCT/BE03/00043

§ 371 (c)(1),
(2), (4) Date: May 31, 2005

(87) PCT Pub. No.: WO03/078783

PCT Pub. Date: Sep. 25, 2003

(65) Prior Publication Data

US 2005/0211398 A1 Sep. 29, 2005

(30) Foreign Application Priority Data

Mar. 20, 2002 (BE) ..... 2002/0197

(51) Int. Cl.
*E06B 9/58* (2006.01)

(52) U.S. Cl. ..... 160/273.1; 160/194; 160/268.1

(58) Field of Classification Search ..... 160/273.1, 160/271, 272, 277, 268.1, 194
See application file for complete search history.

(56) References Cited

U.S. PATENT DOCUMENTS

| | | | | | |
|---|---|---|---|---|---|
| 1,694,314 | A * | 12/1928 | Dixson | ..... | 160/273.1 |
| 1,779,646 | A * | 10/1930 | Traut | ..... | 160/271 |
| 1,786,054 | A * | 12/1930 | Dixson | ..... | 160/273.1 |
| 4,478,268 | A * | 10/1984 | Palmer | ..... | 160/310 |
| 4,884,617 | A | 12/1989 | Coenraets | | |
| 5,526,865 | A * | 6/1996 | Coenraets | ..... | 160/272 |
| 7,036,549 | B2 * | 5/2006 | Coenraets | ..... | 160/271 |

* cited by examiner

*Primary Examiner*—Blair M. Johnson
(74) *Attorney, Agent, or Firm*—Browdy and Neimark

(57) ABSTRACT

The invention relates to a shutter device intended to close a bay (6) or other opening, with flexible edges (2, 3) projecting with respect to the plane of the shutter (1) and collaborating with guideways (4, 5), at least one reintroduction element (12) being provided, allowing the said edges (2, 3) to be reintroduced into the guideways (4, 5) when these edges (2, 3) become disengaged from the latter under the action of a force exerted on these edges (2, 3) in a direction transverse to the guideways (4, 5), a contact area (37) being formed during this reintroduction between the reintroduction element (12) and the corresponding edge (2, 3), characterized in that the lateral edges (2, 3) consist at least partially of an elastomeric material so that the said contact area (37) increases as the said force increases, spreading this force over the contact area (37).

17 Claims, 7 Drawing Sheets

SHUTTER DEVICE WITH FLEXIBLE LATERAL EDGES

The invention relates to a shutter device intended to close a bay or other opening, with flexible edges projecting with respect to the plane of the shutter and collaborating with guideways, at least one reintroduction element being provided, allowing the said edges to be reintroduced into the guideways when these edges become disengaged from the latter under the action of a force exerted on these edges in a direction transverse to the guideways, a contact area being formed during this reintroduction between the reintroduction element and the corresponding edge.

The invention relates in particular to a shutter device the lateral edges of the shutter of which can disengage from the guideways, for example when there is an obstacle between the guideways as the shutter closes or when a vehicle collides with the shutter. The reintroduction element provided at the location of the upper part of the guideways allows the lateral edges of the shutter to be reintroduced into the guideways during its upwards movement.

The operation of known shutter devices is disrupted when one of the lateral edges of the shutter becomes disengaged from its guideway. What happens is that the said lateral edges can thus become damaged at the location of their area of contact with the reintroduction means or may become jammed in this reintroduction element. This has the result that the lateral edges of the shutter have to be freed manually from the reintroduction element, and often require very labour-intensive repair. These problems are particularly significant when the lateral edges of the shutter are formed of a succession of rigid blocks.

One of the essential objects of the present invention is to propose a shutter device the lateral edges and the reintroduction element of which cannot become damaged when a force higher than a predetermined force is exerted on these edges of the shutter during the upwards movement thereof.

To this end, according to the invention, the reintroduction element and the projecting edge collaborate with one another in such a way that, as soon as the force exerted on the edge in a direction transverse to the guideways exceeds a determined value, the area of contact between the reintroduction element and the corresponding edge undergoes displacement with respect to a longitudinal axis of the projecting edge situated a certain distance away from the contact area, allowing the edge to disengage from the reintroduction element.

According to one advantageous embodiment of the invention, the said edges of the shutter are made of a flexible and deformable shape-memory material so that these edges revert to their original shape after deformation under the effect of the aforesaid displacement of the contact area.

Advantageously, the said edges are made of an elastomeric material. These edges in particular have a Shore A hardness of between 65 and 100, and are preferably made at least partially of polyurethane.

According to a particular embodiment of the invention, the hardness of the edges is chosen so that, when a tensile force transverse to the longitudinal direction of the guideways is exerted on the said edges, these edges disengage from their corresponding guideway without being considerably deformed whereas, when this force exceeds a certain value, these edges deform more, temporarily, in order to be able to disengage from the reintroduction element.

According to a specific embodiment of the invention, the reintroduction element is mounted elastically on a support so that when the said tensile force exceeds the aforementioned determined value, the reintroduction element is temporarily displaced under the action of the corresponding edge so as to allow the latter to disengage from the reintroduction element.

According to an alternative embodiment of the invention, the reintroduction element is made of a deformable shape-memory material so that when the said tensile force exceeds the aforementioned determined value, the reintroduction element is deformed under the action of the corresponding edge as the latter disengages from the reintroduction element.

Other details and particulars of the invention will become apparent from the description given hereinafter, by way of non-limiting example, of some particular embodiments of a shutter device according to the invention, with reference to the appended drawings.

In the various figures, the same reference numerals relate to the same elements or to elements which are analogous.

In general, the present invention relates to a shutter device collaborating with drive means, such as a drum the spindle of which is connected to the shaft of an electric motor. The shutter moves in a downwards and upwards movement between, respectively, a closed position and an open position, and is intended to close a bay in a wall or a passage, such as a corridor.

The word "shutter" is to be understood, within the context of the present invention, as meaning any flat. at least partially supple or flexible element such as a tarpaulin, a strip of plastic, a metal gauze, a trellis, a metal sheet, a sectional door, etc.

However, it should be noted that a pronounced preference is afforded to supple shutters formed, for example, of a tarpaulin. The appended figures therefore relate more specifically to such a tarpaulin.

Figure 1:
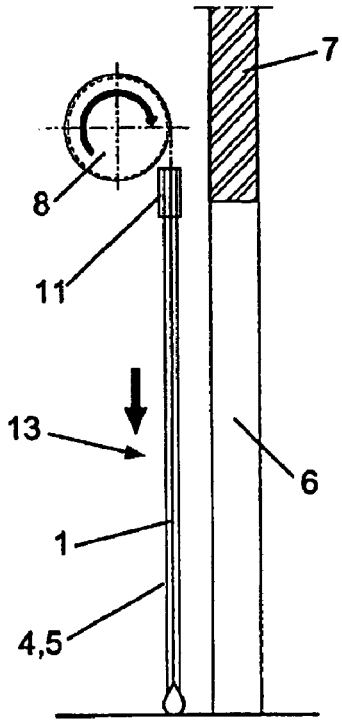
FIG. 1 is a schematic view in vertical section of a first embodiment of a shutter device according to the invention with the shutter in the closed position.
Figure 2:
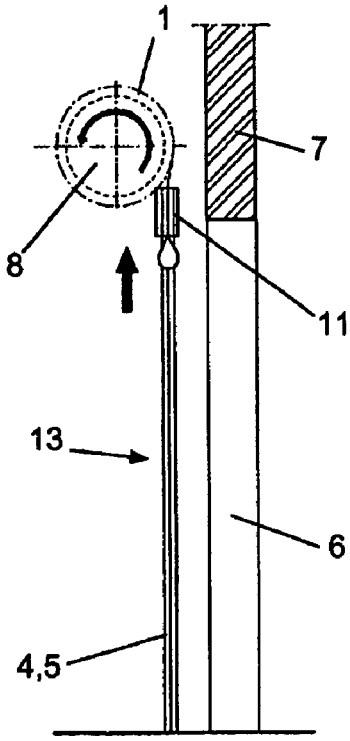
FIG. 2 is a view similar to that of FIG. 1, with the shutter in its open position.
Figure 3:
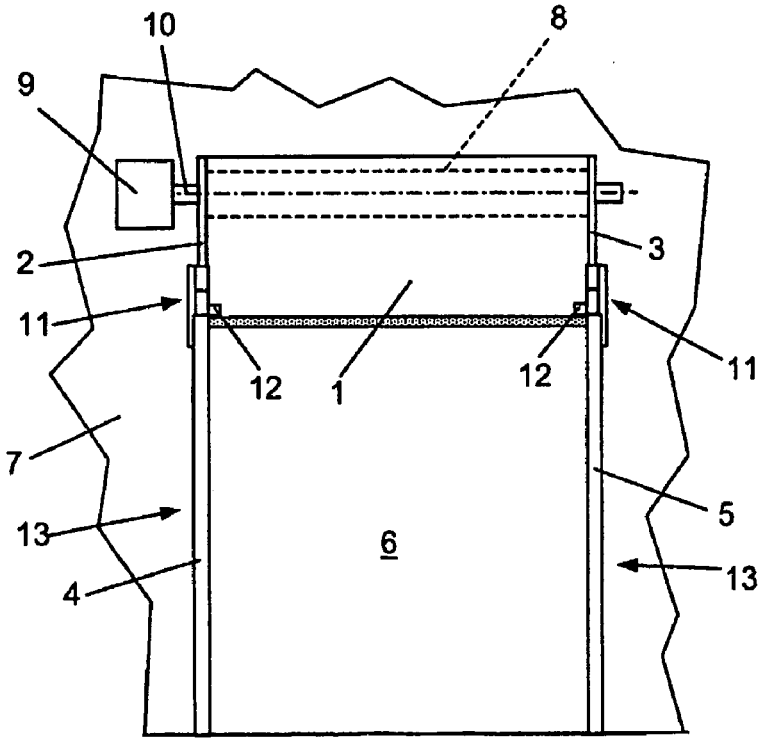
FIG. 3 is a front view of the shutter device in the open position.
Figure 4:
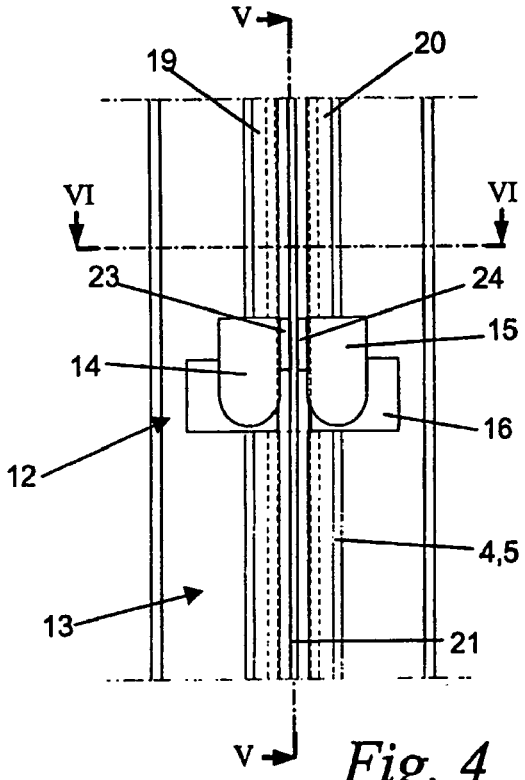
FIG. 4 is, on a larger scale, a schematic front depiction of the reintroduction element according to a first embodiment of the shutter device according to the invention.
Figure 5:
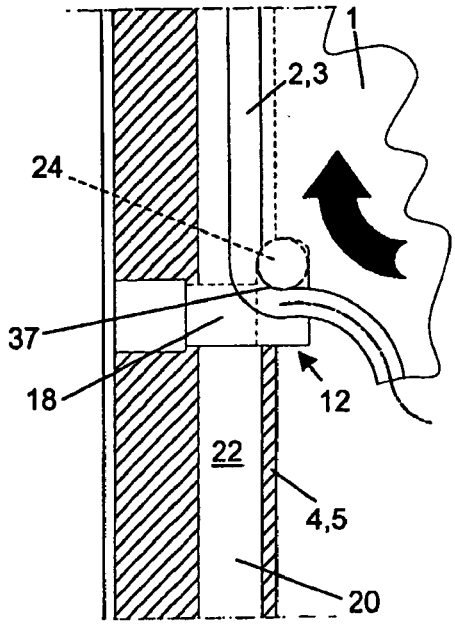
FIG. 5 is a section on V-V of FIG. 4.
Figure 6:
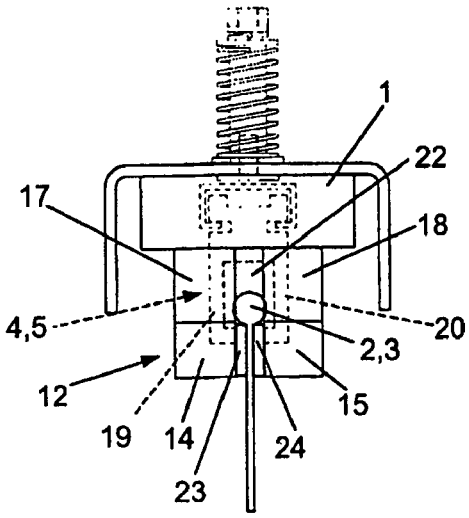
FIG. 6 is a section on VI-VI of FIG. 4.
Figure 7:
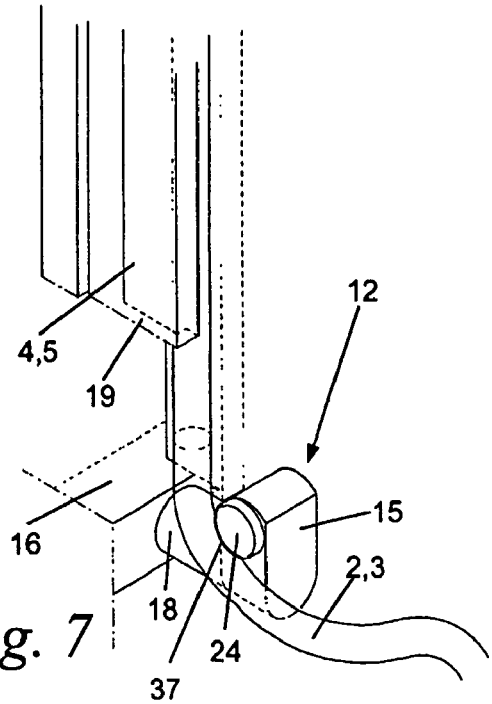
FIG. 7 is a perspective view of the reintroduction element of FIG. 4, with a lateral edge of the shutter.

In FIG. 1, the shutter device is depicted schematically in the closed position whereas in FIGS. 2 and 3 the shutter device is shown in the open position. This device comprises a shutter 1 with lateral edges 2 and 3 projecting with respect to the plane of the shutter which are advantageously formed by a continuous bulge or by a succession of little blocks articulated to one another and running in guideways 4 and 5. The guideways 4 and 5 are provided on each side of a bay 6 which is present in a wall 7.

Above the bay 6 there is a drum 8 on which the shutter 1 can be wound. Drive means 9, such as an electric motor for example, actuate a shaft 10 which extends along the axis of the drum 8 so as to be able to wind the shutter 1 onto the drum 8 to bring it into the open position or so as to be able to unwind it into its closed position.

The guideways 4 and 5 comprise, at the location of their upper part 11, a reintroduction element 12.

This reintroduction element 12 allows the lateral edges 2 and 3 to be reintroduced into the guideways 4 and 5 during the opening of the shutter 1 when these edges become disengaged from the lower part 13 of the guideways 4 and 5 below the reintroduction element 12. The lateral edges 2 and 3 may, for example, become disengaged when there is an obstacle between the guideways 4 and 5 during closure of the shutter 1 or when, for example, a vehicle collides with the shutter 1.

The guideways 4 and 5 have a U-section with two legs 19 and 20. The edges of these legs 19 and 20 are bent towards each other, delimiting a slot 21. Thus, a channel 22 is formed in which the lateral edges 2 and 3 of the shutter 1 are guided while the region of the shutter 1 near these edges 2 and 3 extends through the slot 21. When the lateral edges 2 and 3 become disengaged from the lower part 13 of the guideways 4 and 5, the said legs 19 and 20 part from one another elastically under the effect of a tensile force exerted on these lateral edges 2 and 3 by the shutter 1.

FIGS. 4 to 7 depict the reintroduction element 12 on a larger scale. This reintroduction element 1-2 comprises a base block 16 housed between the upper part 11 of the guideways 4 and 5 and the lower part 13 thereof. Two parallel cylinders 14 and 15 extend along this base block 16 a certain distance apart, so that the said channels 22 extends between these cylinders 17 and 18 and so that, as a result, the lateral edges 2 and 3 of the shutter 1 can be displaced through the space formed between these cylinders 17 and 18.

In the region of the said slot 21, there is a guide member 14 and 15 on each cylinder 17 and 18 projecting with respect to the guideways 4 and 5. These guide members 14 and 15 have a rounded surface on their side facing the lower part 13 of the guideways 4 and 5. The distance between the guide members 14 and 15 corresponds roughly to the thickness of the lateral edges 2 and 3 of the shutter 1.

The guide members 14 and 15 extend over a certain distance along the upper part 11 of the guideways 4 and 5 and, at their surface facing one another, are each provided with a circular section 23 and 24 situated facing this upper part 11 of the guideways 4 and 5. The distance between these circular sections 23 and 24 is slightly greater than the thickness of the shutter 1, but less than the thickness of the lateral edges 2 and 3, which means that during the upwards or downwards movement of the shutter 1, while the lateral edges 2 and 3 are guided in the guideways 4 and 5, the shutter can run between these circular sections 23 and 24.

When the lateral edges 2 and 3 of the shutter 1 are disengaged from the lower part 13 of the guideways 4 and 5, these edges 2 and 3 are reintroduced into the guideways 4 and 5 during the upwards movement of the shutter 1. In particular, during this upwards movement, the lateral edges 2 and 3 are, at the location of the guide members 14 and 15, guided by the said rounded surface of the latter towards a position facing the slot 21 and the channel 22. At the same time, the circular sections 23 and 24 press against the lateral edges 2 and 3 of the shutter 1 on each side of the plane thereof, forcing these edges 2 and 3 back into the upper part 11 of the guideways 4 and 5.

According to the prior art, the lateral edges 2 and 3 of the shutter 1, collaborating with the reintroduction element described hereinabove, consisted of a succession of rigid teeth hinged together. During the reintroduction of the lateral edges 2 and 3 of the shutter 1 into the guideways 4 and 5, it frequently happened that a relatively high force was exerted on the edges of the shutter, for example because of the wind or because a vehicle had not yet completely passed through the bay 6. Because of the presence of such a force, in a direction transverse to the guideways 4 and 5, a very high pressure was exerted at the location of the point of contact between the reintroduction element 12 and the corresponding tooth of the lateral edge 2 and 3 of the shutter 1, causing that tooth to be destroyed, or causing the shutter 1 to jam or to leave the reintroduction element 12.

More specifically, during reintroduction of the lateral edge 2 or 3 into the guideways 4 or 5, each tooth was pressed successively against the guide member 14 and 15 before being reintroduced into the guideway. In consequence, the entire reintroduction force was constantly applied to a single tooth in contact with a single point on the guide member 14 or 15. When this force was higher than the strength of this tooth, the latter would break and render the shutter device non-operational.

According to the invention, the lateral edges 2 and 3 of the shutter 1 are made of a material able to temporarily deform, thus exhibiting shape-memory. In particular, the hardness of the lateral edges 2 and 3 of the shutter 1, the thickness of the projecting edge 2 and 3 and the distance between the guide members 14 and 15 are chosen so that when the said force exerted on the lateral edges 2 and 3 by the reintroduction element exceeds a determined value, these edges 2 and 3 deform elastically, allowing the edges 2 and 3 to disengage from the reintroduction element 12.

The said determined value of the force exerted on the lateral edges 2 and 3 is lower than the yield strength of these lateral edges 2 and 3, which means that these edges cannot be broken, but deform when a higher force is exerted on these edges.

Advantageously, the lateral edges 2 and 3 of the shutter 1 are made of an elastomeric material, such as polyurethane. It has been found that such an elastomer with a Shore A hardness of between 75 and 100 and, in particular, a Shore A hardness of between 75 and 95, gives excellent results. As a preference, the lateral edges 2 and 3 of the shutter 1 have a Shore A hardness of between 90 and 95.

When lateral edges 2 and 3, the hardness of which is chosen as explained hereinabove, have become disengaged from the lower part 13 of the guideways 4 and 5, a area of contact is formed between the reintroduction element 12 and these edges 2 and 3 during the upwards movement of the shutter 1. The presence of a contact area 37 has the result that the force, exerted between the lateral edges 2 and 3 and the reintroduction element 12, is spread over this contact area 37 and is no longer concentrated in a point of contact, as was the case in the prior art.

Figure 8:
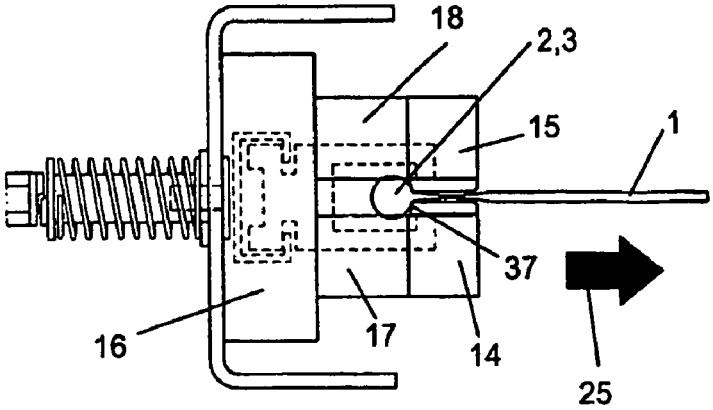
FIGS. 8 to 11 depict sections on VI-VI of FIG. 4, with various successive steps in the disengagement of the lateral edge of the shutter with respect to the reintroduction element.
Figure 9:
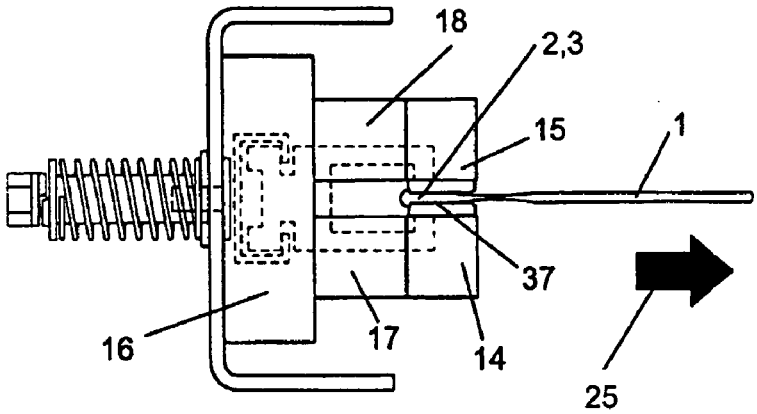
Figure 10:
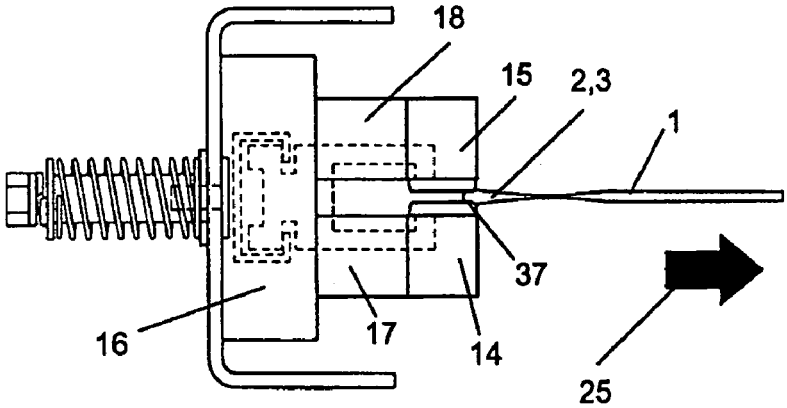

If, for some reason or another, this force exceeds the aforementioned determined value, the lateral edges deform, as illustrated in FIGS. 8 to 9, causing the lateral edges 2 and 3 to disengage from the reintroduction element 13. The lateral edges 2 and 3 of the shutter 1, depicted in FIGS. 4 to 7, consist of a bulge which means that, during this deformation, this bulge is compressed gradually so as to be able to pass through the space between the said circular sections 23 and 24. The area of contact 37, between the reintroduction element 13 and the lateral edges 2 and 3, then undergoes a displacement with respect to the axis of these lateral edges 2 and 3. This contact area 37 moves closer towards the central axis of the lateral edges 2 and 3 while the latter are being compressed.

Figure 11:
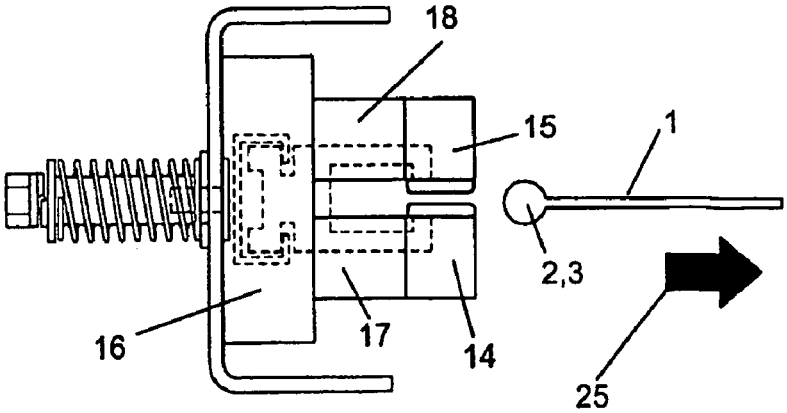

FIGS. 8 to 11 depict successive steps of this deformation of a lateral edge 2 or 3 of the shutter 1 when a tensile force in the direction of the arrow 25 is exerted on this edge by the shutter 1. After the lateral edges 2 and 3 have disengaged from the reintroduction element 12, they revert to their original shape and size, as shown in FIG. 11.

Through the choice of the aforementioned hardness of the lateral edges 2 and 3, it is possible to avoid these edges being able to become deformed during normal use of the shutter device according to the invention. In particular, when the lateral edges 2 and 3 of the shutter 1 have a hardness of a value lower than the values mentioned hereinabove, there is a risk that they will deform too much and therefore disengage from the lower part 13 of the guideways 4 and 5 as a result of action of the wind on the shutter 1 when the latter is in its closed position.

The hardness of the edges 2 and 3 is, in particular, chosen so that, when a tensile force transverse to the longitudinal direction of the guideways 4 and 5 is exerted on the said edges 2 and 3, these edges disengage from their corresponding guideways 4 and 5 without being considerably deformed whereas, when this force exceeds the said determined value, these edges 2 and 3 deform more, temporarily, in order to be able to disengage from the reintroduction element 12.

The aforementioned values for the hardness of the edges 2 and 3 is, more specifically, applicable when the ratio between the distance separating the guide members 14 and 15, particularly the distance between the circular sections 23 and 24, and the thickness of the lateral edges 2 and 3 is between 3/10 and 7/10, particularly between 3.5/10 and 6.5/10. This ratio is preferably between 4.5/10 and 5.5/10.

Figure 12:
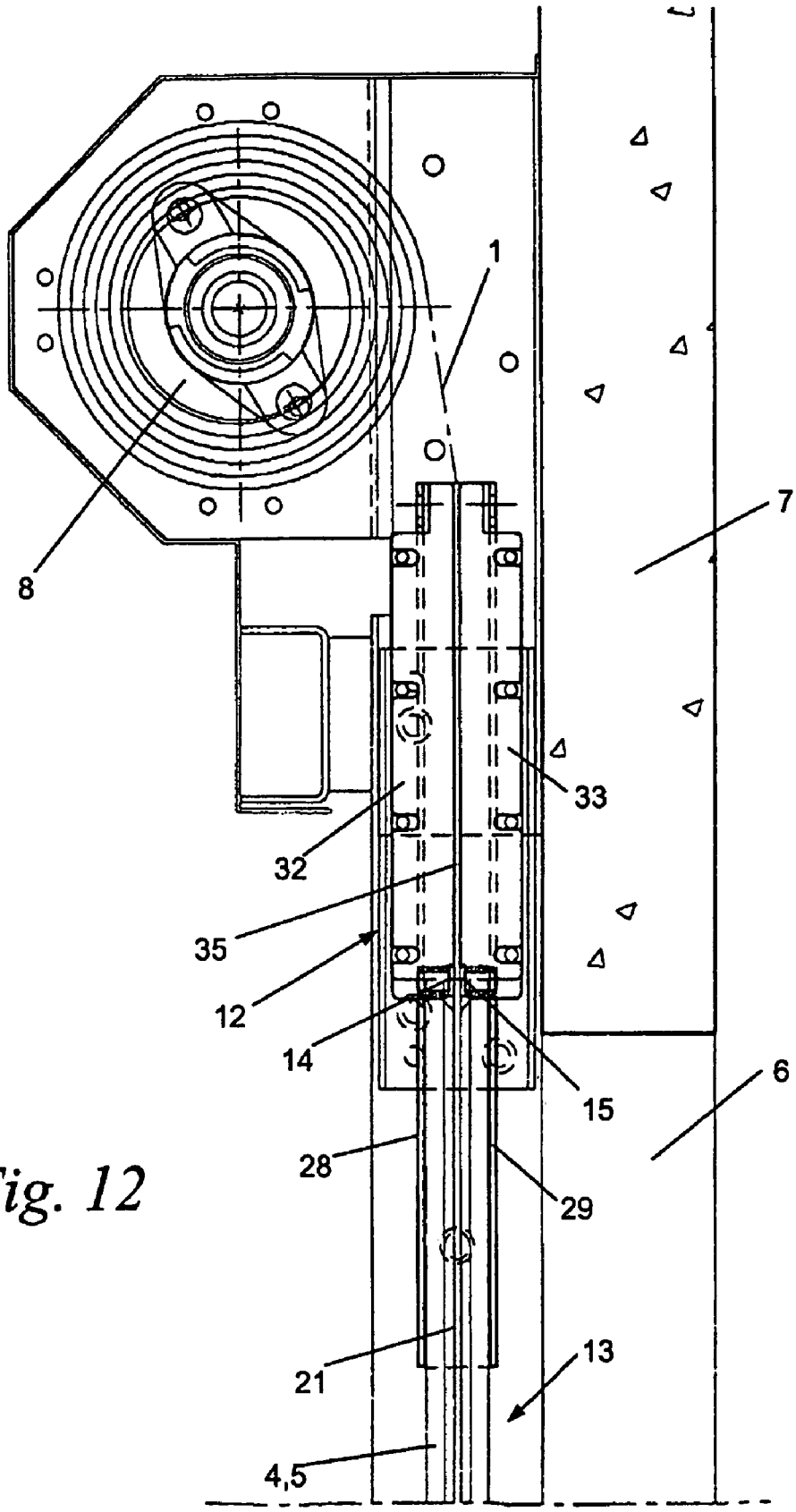
FIG. 12 is a side view of the reintroduction element according to a second embodiment of the invention.
Figure 13:
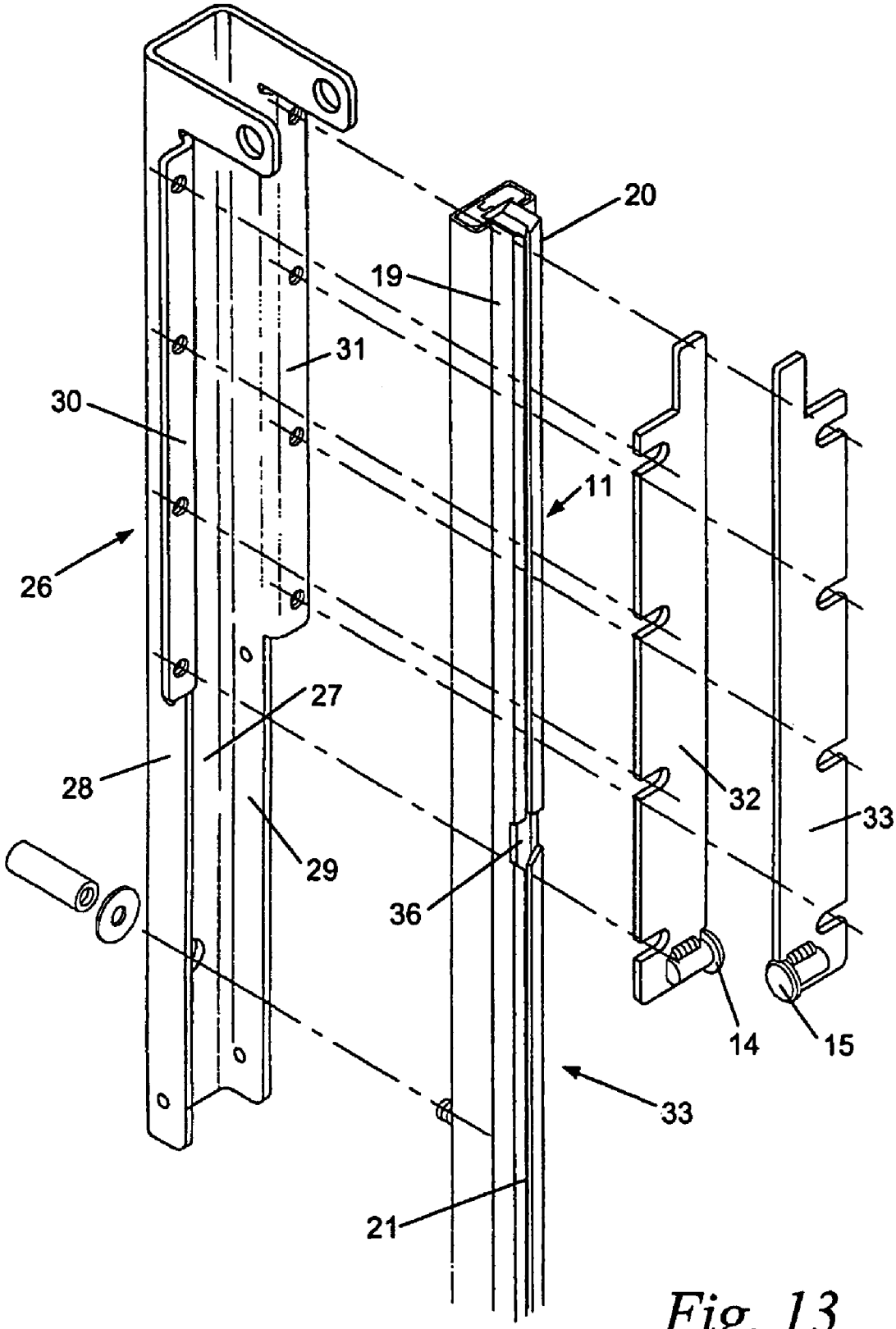
FIG. 13 is an exploded perspective view of the reintroduction element of FIG. 12.
Figure 14:
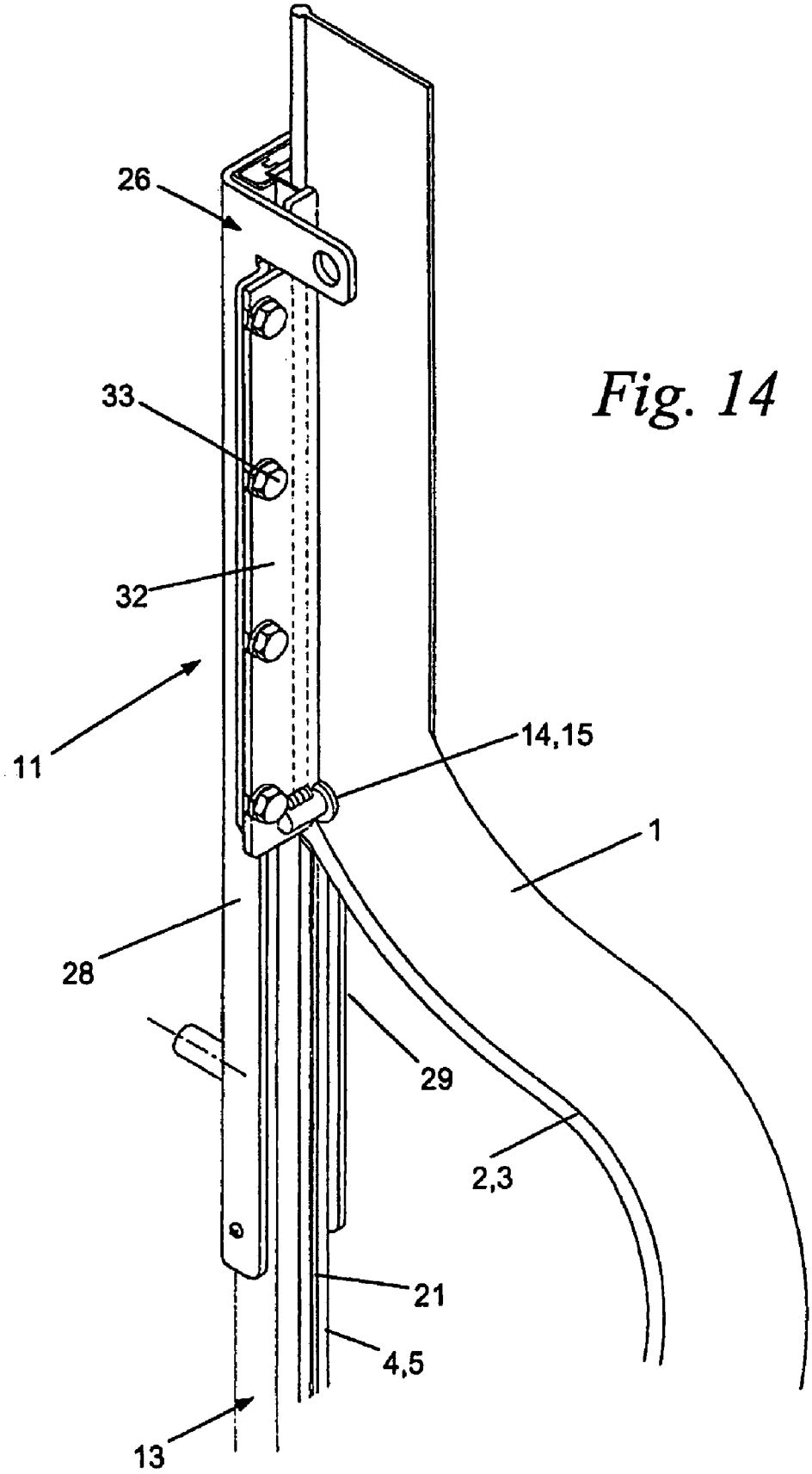
FIG. 14 is a schematic perspective depiction of the reintroduction element of FIG. 12 during the reintroduction of the lateral edge of the shutter into the corresponding guideway.
Figure 15:
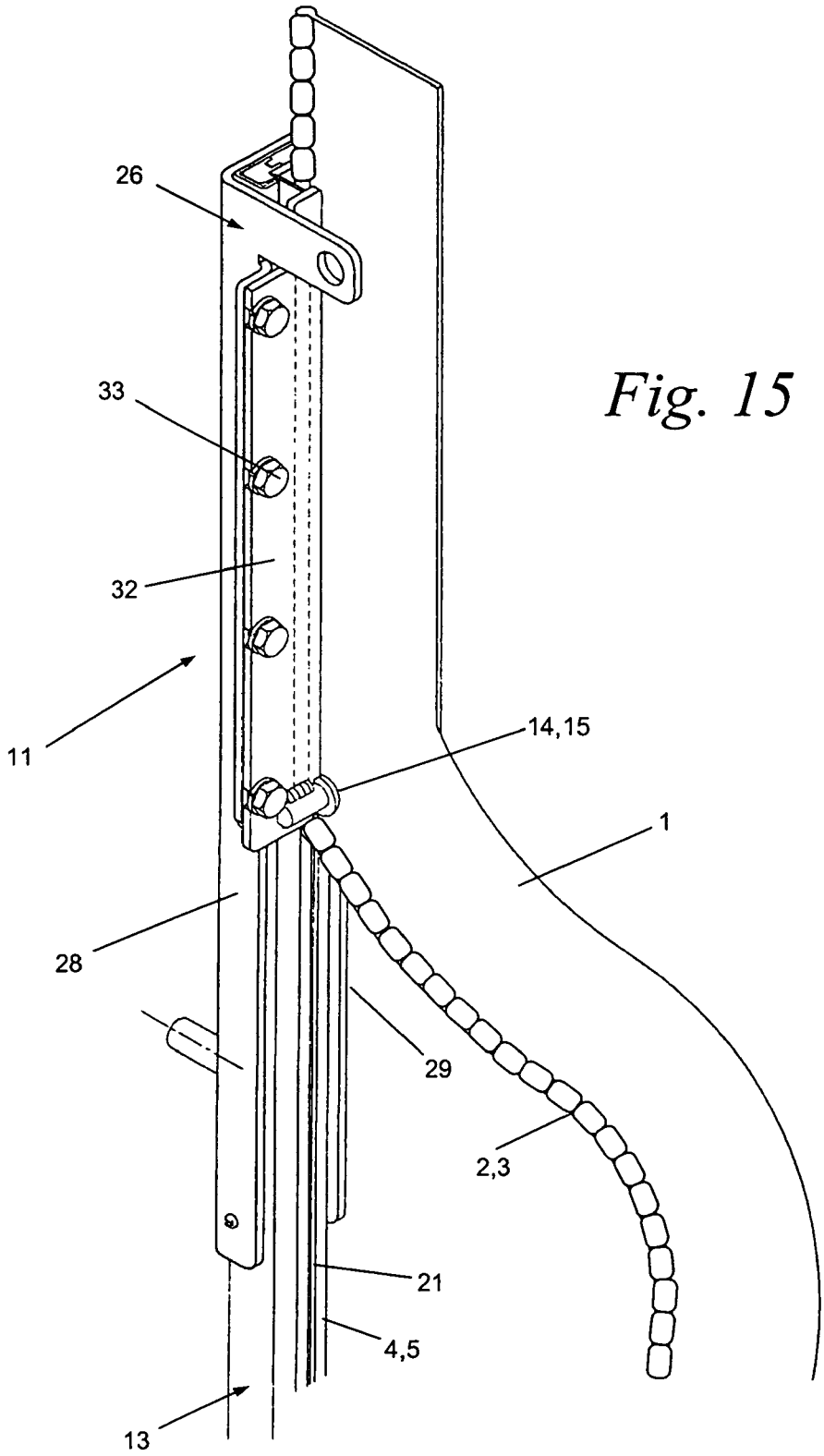
FIG. 15 is a schematic perspective depiction of the reintroduction element of FIG. 12, similar to FIG. 14, showing additional detail.

FIGS. 12 to 14 depict a second embodiment of the reintroduction element according to the invention. In this embodiment, the upper part 11 of the guideways 4 and 5 comprises a chassis 26 having a U-section with a base 27 and two legs 28 and 29. The legs 28 and 29 are bent outwards to form two rims 30 and 31 which run roughly parallel to the base 27. A flat section 32 and 33 is fixed to each of these rims 30 and 31 by means of bolts 34. The flat sections 32 and 33 are each provided with a roughly continuous edge facing one towards the other so that a slot 35 is formed between these flat sections 32 and 33.

The projecting lateral edge 2 or 3 of the shutter 1 is housed in the space formed between the legs 28 and 29 of the chassis 26, the shutter 1 extending then through the slot 35. The width of this slot 35 is slightly greater than the thickness of the shutter 1 and less than the thickness of the projecting edge 2 and 3, which means that this edge cannot leave the space between the legs 28 and 29 without being deformed considerably, while at the same time allowing the shutter itself to slide between the facing edges of the flat sections 32 and 33.

The guideways 4 and 5 are fixed to the chassis 26 between the legs 28 and 29 in such a way that the slot 35 between the flat sections 32 and 33 is aligned with the slot 21 between the legs 19 and 20 of the guideways 4 and 5.

The lower part 13 of the guideways 4 and 5 is separated from the upper part 11 by a recess 36 provided in the guideways 4 and 5.

Each of the flat sections 32 and 33 has, at its lower end, a guide member 14 and 15 which is arranged facing the recess 36. These guide members 14 and 15 have the shape of a circular section the axis of which runs transversely with respect to the longitudinal direction of the guideways 4 and 5 and with respect to the plane of the shutter 1.

As the shutter 1 is opened, after the lateral edges 2 and 3 of the shutter 1 have disengaged from the lower part 13 of the guideways, as depicted in FIG. 14, these guide members 14 and 15 exert a pushing force on the lateral edges 2 and 3 of the shutter 1 so as to reintroduce these into the upper part 11 of the guideways between the legs 28 and 29 of the chassis 28.

The end of the lower part 13 of the guideways facing the guide members 14 and 15 is bevelled so as to ensure continuous movement of the shutter 1 when the latter is moved towards its closed position.

The reintroduction element 12 therefore comprises the said flat sections 32 and 33 with the guide members 14 and 15.

Excellent results have been obtained when, for the hardnesses mentioned hereinabove, the lateral edges 2 and 3 consist of a continuous bulge with a circular cross section of a diameter of 6 mm and when the distance between the guide members 14 and 15 is of the order of 3 mm. In such a case, the thickness of the shutter 1 in the region near the lateral edges 2 and 3 is, for example, 2 mm.

When the lateral edges 2 and 3 of the shutter disengage from the lower part 13 of the guideways 4 and 5, these edges 2 and 3 are deformed little, but the legs 19 and 20 of the guideways 4 and 5 are moved apart elastically, widening the slot 21, so that the lateral edges 2 and 3 of the shutter 1 can leave the guideways 4 and 5.

During the subsequent upwards movement of the shutter 1, the guide members 14 and 15 press against the lateral edges 2 and 3 of the shutter 1 over a contact area 37 on each side of the plane of the shutter 1, so as to reintroduce these edges 2 and 3 into the upper part 11 of the guideways 4 and 5.

When, during this reintroduction, a tensile force transverse to the direction of the guideways 4 and 5 is exerted on these lateral edges 2 and 3, the said contact area 37 becomes larger as the tensile force increases, spreading the action of this force over the contact area 37. When this force becomes too high and there may be a risk of damage to the guide members 14 or 15 or to the lateral edges 2 and 3, the latter deform elastically and disengage, without any damage, from the reintroduction element 13 and therefore from the upper part 11 of the guideways 4 and 5.

Before the shutter 1 is moved again towards its closed position, the lower end of the lateral edges 2 and 3 of the shutter 1 is inserted, for example by hand, into the upper part 11 of the guideways 4 and 5. Thereafter, the shutter device can again operate without any additional repair being needed.

Although, in the aforementioned description, the guide members 14 and 15 are made of a rigid material, for example metal, and the lateral edges consist of an elastically deformable material, it is perfectly possible for the lateral edges 2 and 3 of the shutter 1 to comprise a succession of rigid teeth, whereas the guide members 14 and 15 are made of an elastic material. Thus, when reintroducing the lateral edges 2 and 3 of the shutter 1 into the guideways 4 and 5, an area of contact 37 is formed in succession between each tooth and the guide members 14 and 15. When a tensile force higher than a determined value is exerted on the lateral edges 2 and 3 of the shutter 1, the guide members 14 and 15 deform further so as to disengage these lateral edges 2 and 3 from the reintroduction element 12.

In another embodiment of the shutter device according to the invention, the reintroduction element 12 is mounted elastically on a support so that when the said tensile force exceeds the aforementioned determined value, the reintroduction element 12 is temporarily displaced under the action of the lateral edges 2 and 3 so as to allow the latter to disengage from this reintroduction element 12. As the lateral edges 2 and 3 are disengaged from the reintroduction element 12, the area of contact between these items gradually moves along the lateral edges 2 and 3, away from the shutter 1.

In yet another embodiment of the shutter device according to the invention, the lateral edges 2 and 3 of the shutter 1 are made of elastic discrete elements extending one after the other in the longitudinal direction of the lateral edges of the shutter. Such elements may, for example, form a succession of teeth. These teeth are, in particular, made of an elastomeric material, such as polyurethane, and have the same hardness as the lateral edges 2 and 3 of the shutter 1 of the first and second embodiments of the invention described hereinabove.

It is clear that, in certain cases, the width of the slot 21 of the lower part 13 of the guideways 4 and 5 can be adjusted to allow the lateral edges 2 and 3 of the shutter 1 the ability to disengage from this lower part 13 by deforming somewhat under the action of a tensile force transverse to the guideways 4 and 5. In such a case, it is not necessary for the legs 19 and 20 of the guideways 4 and 5 to separate from one another as described above.

When the lateral edges 2 and 3 are then disengaged from the guideways 4 and 5, and when a high tensile force is exerted on these edges 2 and 3 during the upwards movement of the shutter 1, these edges 2 and 3 deform further so as to be able to disengage from the reintroduction element 12.

If the lateral edges 2 and 3 of the shutter 1 are provided with a rack which collaborates with a sprocket actuated by the said drive means, it is advantageous to provide a reinforcement in these lateral edges 2 and 3. In particular, a fibre, particularly glass-fibre or aramid-fibre reinforcement is provided. These fibres extend along the length of the lateral edges 2 and 3 in these edges 2 and 3 themselves or in the region of the shutter 1 near the edges 2 and 3.

The invention claimed is:

1. Shutter device with a shutter intended to close a bay (6) or other opening, the shutter presenting a plane in a closed position, with flexible edges (2,3) protruding with respect to the plane of the shutter (1) and running in opposing guideways (4,5) having an upper part (11) and a lower part (13), at least one reintroduction element (12) being provided at the upper part (11) of at least one of the guideways, allowing the said edges (2,3) to be reintroduced into the guideways (4,5) during an upwards movement of the shutter when these edges (2,3) have become disengaged from the lower part (13) of the guideways under the action of a force exerted on these edges (2,3) in a direction transverse to the guideways (4,5), wherein this reintroduction element (12) has guide members (14,15) with rounded surfaces on their sides facing the lower part (13) and the at least one guideway respectively, the lateral edges (2,3) being guided by said rounded surfaces during reintroduction of the edges (2,3) into the guideways (4,5), whereby the guide members (14,15) press against the lateral edges (2,3) over a contact surface (37) between the guide members (14,15) of the reintroduction element (12) and the corresponding edge (2,3) during this reintroduction, wherein the lateral edges (2,3) consist at least partially of an elastomeric material so that the said contact surface (37) increases as the said force increases, spreading this force over the contact area (37).

2. Shutter device according to claim 1, characterized in that the reintroduction element (12) and the projecting edge (2, 3) collaborate with one another in such a way that, as soon as the aforesaid force exerted on the edge (2, 3) exceeds a determined value, the said contact area (37) undergoes displacement with respect to a longitudinal axis of the projecting edge (2, 3) situated a certain distance away from the contact area (37), allowing the edge (2, 3) to disengage from the reintroduction element (12).

3. Device according to claim 1 or 2, characterized in that the said edges (2, 3) are made of a flexible and deformable shape-memory material so that these edges (2, 3) revert to their original shape after deformation under the effect of the aforesaid displacement of the contact area (37).

4. Device according to claim 1, characterized in that the said edges (2, 3) have a Shore A hardness of between 75 and 100.

5. Device according to claim 1, characterized in that the said edges (2, 3) are made at least partially of polyurethane.

6. Device according to claim 1, characterized in that the lateral edges (2, 3) of the shutter (1) are provided with a fibre, optionally glass-fibre or aramid-fibre reinforcement.

7. Device according to claim 6, characterized in that the aforesaid fibres extend along the length of the said edges (2, 3).

8. Device according to claim 1, characterized in that the hardness of the edges (2, 3) is chosen so that, when a tensile force transverse to the longitudinal direction of the guideways (4, 5) is exerted on the said edges (2, 3), these edges (2, 3) disengage from their corresponding guideway (4, 5) without being considerably deformed whereas, when this force exceeds a certain value, these edges (2, 3) deform more, temporarily, in order to be able to disengage from the reintroduction element.

9. Device according to claim 1, characterized in that the reintroduction element (12) is mounted elastically on a support so that when the said tensile force exceeds the aforementioned determined value, the reintroduction element (12) is temporarily displaced under the action of the corresponding edge (2, 3) so as to allow the latter to disengage from the reintroduction element (12).

10. Device according to claim 1, characterized in that the reintroduction element (12) is made of a deformable shape-memory material so that when the said tensile force exceeds the aforementioned determined value, the reintroduction element (12) is deformed under the action of the corresponding edge (2, 3) as the latter disengages from the reintroduction element (12).

11. Device according to claim 1, characterized in that at least two reintroduction elements (12) are provided, arranged on each side of the plane of the shutter.

12. Device according to claim 1, characterized in that the said edges (2, 3) are roughly continuous.

13. Device according to claim 1, characterized in that the said edges (2, 3) consist of discrete elements extending one after the other in the longitudinal direction of the lateral edges (2, 3) of the shutter (1).

14. Device according to claim 1, characterized in that the said edges (2, 3) form part of the shutter (1).

15. Device according to claim 3, characterized in that the said edges (2, 3) have a Shore A hardness of between 75 and 100.

16. Device according to claim 15, characterized in that the said edges (2, 3) are made at least partially of polyurethane.

17. Shutter device according to claim 4, characterized in that the reintroduction element (12) and the projecting edge (2, 3) collaborate with one another in such a way that, as soon as the aforesaid force exerted on the edge (2, 3) exceeds a determined value, the said contact area (37) undergoes displacement with respect to a longitudinal axis of the projecting edge (2, 3) situated a certain distance away from the contact area (37), allowing the edge (2, 3) to disengage from the reintroduction element (12).

* * * * *